US006217294B1

(12) United States Patent
Arnieri et al.

(10) Patent No.: US 6,217,294 B1
(45) Date of Patent: Apr. 17, 2001

(54) COMBINATION CONTAINER WITH MOUNTED FAN

(76) Inventors: Terry E. Arnieri, 440 Tara La., Addison, IL (US) 60101; Gregory A. Steiner, 7 S 550 Donwood Dr., Naperville, IL (US) 60567

( * ) Notice: Subject to any disclaimer, the term of this patent is extended or adjusted under 35 U.S.C. 154(b) by 0 days.

(21) Appl. No.: 09/249,260

(22) Filed: Feb. 16, 1999

(51) Int. Cl.[7] ..... F04B 17/06; B67D 5/52

(52) U.S. Cl. ..... 417/239; 222/135

(58) Field of Search ..... 417/239, 236, 417/238; 215/121; 220/420, 411, 415; 141/379; 206/547, 24; 222/131, 129; 261/24

(56) References Cited

U.S. PATENT DOCUMENTS

| | | | | |
|---|---|---|---|---|
| D. 404,564 | * | 1/1999 | Rausch | D3/229 |
| 2,007,730 | * | 7/1935 | Terry | 230/58 |
| 2,351,226 | * | 6/1944 | Pernhall | 261/30 |
| 3,997,115 | * | 12/1976 | Licudine | 239/351 |
| 4,120,615 | * | 10/1978 | Keem et al. | 417/360 |
| 4,365,930 | * | 12/1982 | Ogura et al. | 415/61 |
| 5,125,069 | * | 6/1992 | O'Boyle | 392/6 |
| 5,402,916 | * | 4/1995 | Nottingham et al. | 222/134 |
| 5,620,633 | * | 4/1997 | Junkel et al. | 261/28 |
| 5,680,944 | * | 10/1997 | Rueter | 215/13.1 |
| 5,683,636 | * | 11/1997 | Spek et al. | 264/45.7 |
| 5,829,607 | * | 11/1998 | Ibrahim | 215/44 |
| 6,003,718 | * | 12/1999 | Lu | 220/592.2 |
| 6,010,034 | * | 1/2000 | Walthers | 222/135 |
| 6,027,137 | * | 2/2000 | Rura | 280/650 |

* cited by examiner

*Primary Examiner*—Teresa Walberg
*Assistant Examiner*—Daniel Robinson
(74) *Attorney, Agent, or Firm*—Basil E. Demeur; Alan B. Samlan

(57) ABSTRACT

There is provided a combination container and portable electrically operated fan unit combination pursuant to which the fan unit may be carried on a mounting surface associated with the container. Holding means is provided for retaining the fan unit in position on the mounting surface portion of the container such that the apparatus presents a combination container and cooling unit.

16 Claims, 4 Drawing Sheets

FIG. 1
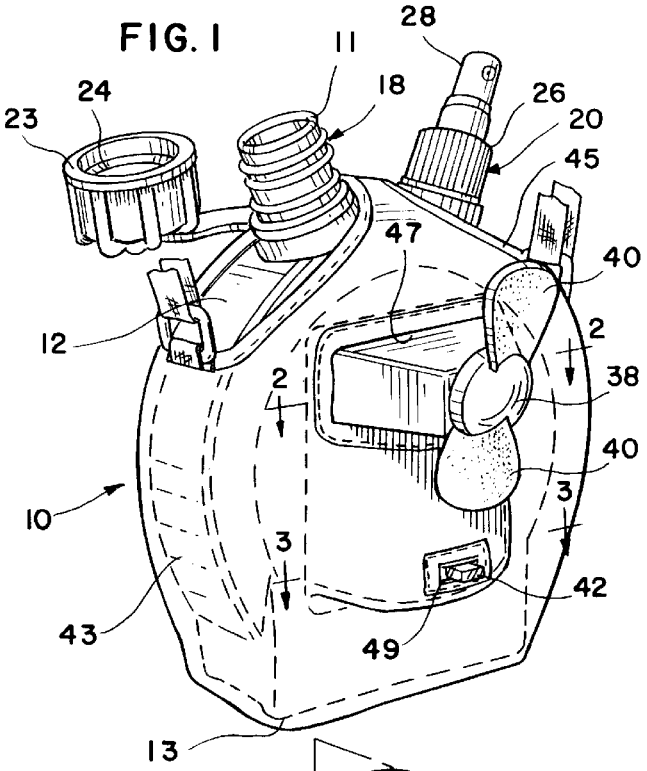
FIG. 2
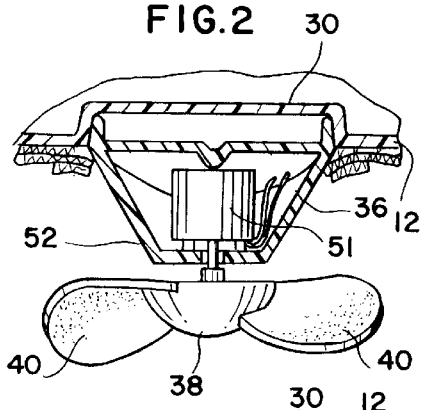
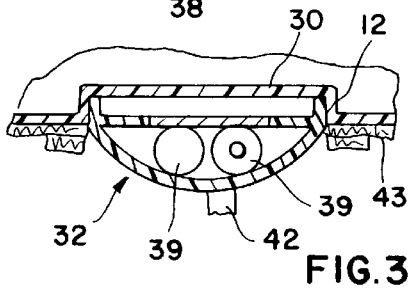
FIG. 3
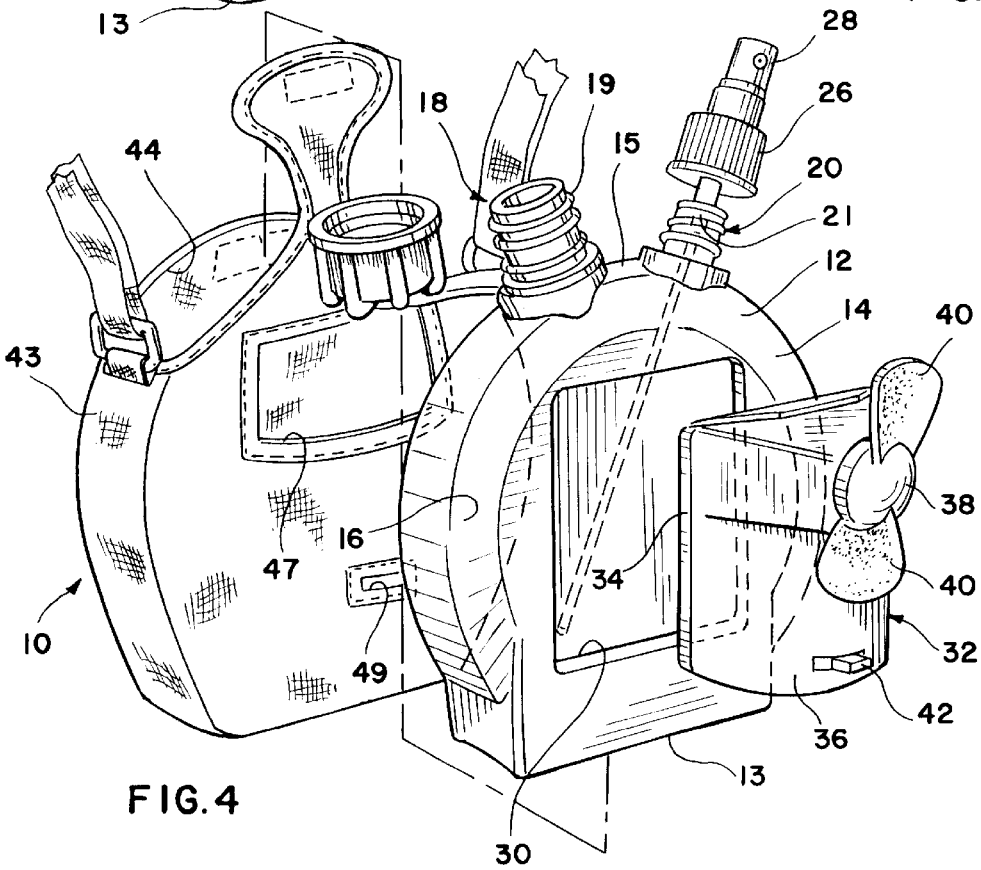
FIG. 4

COMBINATION CONTAINER WITH MOUNTED FAN

BACKGROUND OF THE INVENTION

The present invention presents a novelty apparatus which combines a fluid reservoir type container with a portable battery operated fan device.

A variety of fan devices are now presently on the market, and present a variety of novelty apparatus for the consumer. Typically, such types of products include containers having a fan device having mounted on the top thereof, and incorporating a pump device such that when the fan is actuated, and the pump is actuated to pump water from the fluid reservoir container, a cooling or misting effect is achieved. A variety of battery operated portable hand-held fan devices are available, to present other types of products which the user may employ in order to achieve a cooling effect. Within the frame work of such types of devices, the present invention provides a fluid reservoir in the form of a container, which has a portable battery operated fan device associated therewith. The fluid reservoir device is intended to contain and carry a source of fluid which the user may ingest, and the portable battery operated fan device is adapted to be disengageably mountable onto the fluid reservoir container so that it may be employed as a fan either when mounted on the container, or removed to be used by the consumer as a separate fan device.

Further, the present invention provides alternate forms of such types of apparatus which may be varied in connection with the type of fluid reservoir container as may be desired by the consumer.

OBJECTS AND ADVANTAGES

It is therefore the object of the present invention to provide a combination fluid reservoir container having associated therewith a portable battery operated fan device which may be disengageably mounted to the container.

In conjunction with the foregoing object, it is a further object of the present invention to provide a fluid reservoir container which is adapted to accommodate and contain a fluid suitable for ingestion by the consumer thereby functioning as a water supply reservoir in the nature of a bottle, and permitting the entire apparatus to carry a portable fan therewith for cooling purposes.

In conjunction with the foregoing objects, a further object of the present invention is to present an alternate embodiment wherein the fluid reservoir container may be a divided container providing two chambers, one of which would be adapted to carry drinking fluid, and the other chamber adapted to carry water or any other cooling fluid, each chamber provided with a separate filling port. The chamber adapted to carry a drinking fluid is provided with a port from which the consumer would drink the fluid, while the chamber provided with cooling fluid is provided with a pump device such that fluid from the chamber may be pumped by depressing a hand-operated pump in order to achieve a cooling effect for the user. The fan may then be removed to further enhance the cooling effect to be achieved.

Further objects and advantages will be understood by reference to the following specification taken in conjunction with the accompanying drawings.

SUMMARY OF THE INVENTION

In summary, the present invention provides a fluid reservoir container which is in combination with a portable battery operated fan device which may be disengageably mounted onto the container. The container is adapted by being provided with a mounting surface associated with the container, and the fan device is provided with a mating configuration designed to fit within and be accommodated on the mounting surface of the container. Holding means are provided in order to hold the fan in position on the container in disengageably engageable fashion.

A further alternate embodiment is presented wherein the container may have a wall dividing the fluid reservoir container into two chambers, such that one chamber may contain a drinking fluid, while the other chamber contains a cooling fluid. Each chamber is provided with a separate port such that the chamber accommodating the drinking fluid permits the user to drink therefrom, while the chamber provided with the cooling fluid may ideally be provided with a manual pump device such that cooling fluid may be pumped from the chamber by the user to achieve a cooling effect. The portable fan mounted thereon may then be used to enhance the cooling effect achieved.

BRIEF DESCRIPTION OF DRAWINGS

In connection with the accompanying drawings;

FIG. 1 is a perspective view of a fluid reservoir having a portable battery operated fan mounted thereon and showing the holding means as a sheath enveloping the entire device;

FIG. 2 is a cross-sectional view taken along the line 2—2 of FIG. 1 showing the manner in which the portable battery operated fan is mounted into a space provided on the container;

FIG. 3 is a cross-sectional view taken in the direction of the Line 3—3 as shown in FIG. 1, showing the lower section of the portable battery operated fan as mounted in the container depression;

FIG. 4 is a plane exploded view showing the container, a portable fan associated therewith, and the enveloping sheath associated therewith;

DETAILED DESCRIPTION OF DRAWINGS

Figure 5:
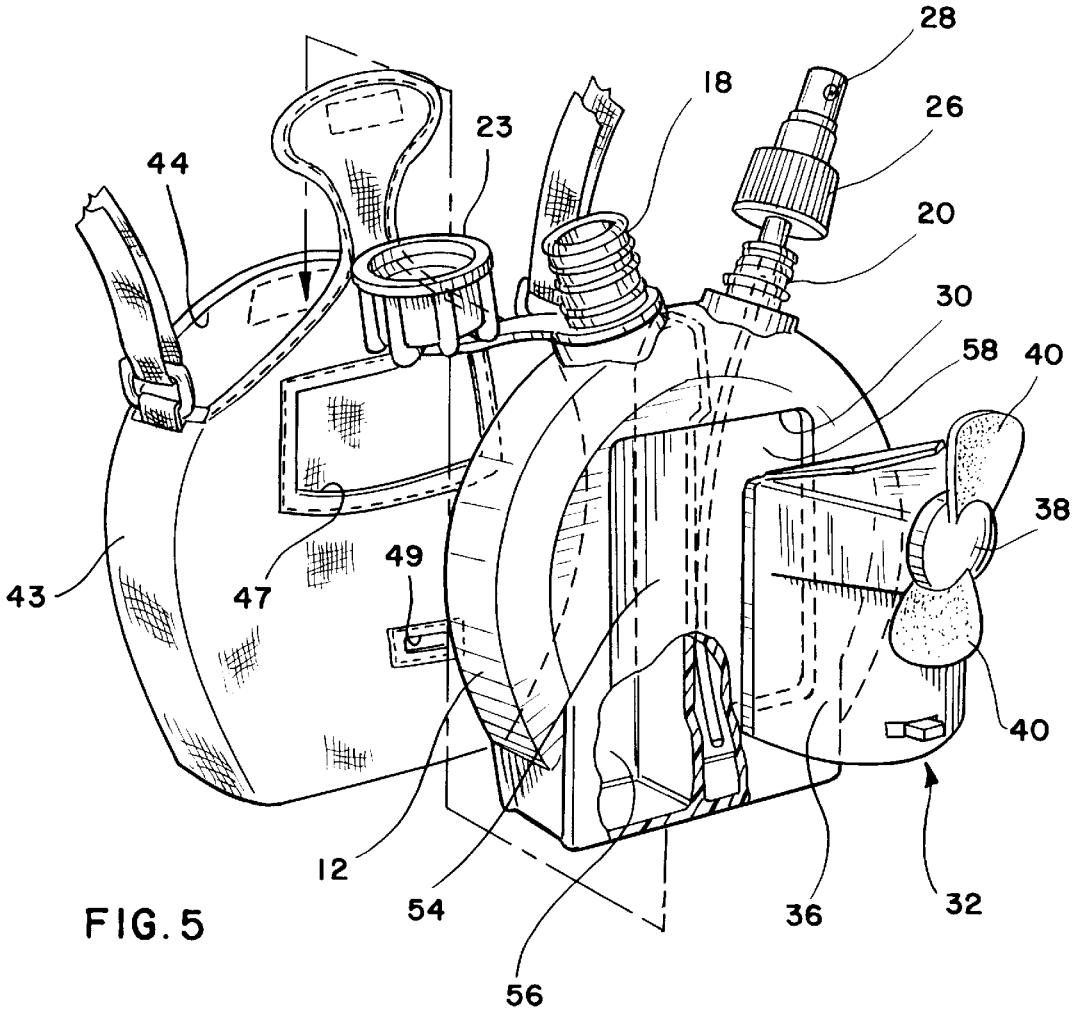
FIG. 5 is a plan exploded view showing an alternate form of the container wherein the container is provided with an internal separation wall in order to form a dual chamber container for a purpose to be described hereinafter.

As will be observed in FIG. 1, the container/fan apparatus 10 is illustrated in one of its embodiments. As is shown in both FIGS. 1 and 4, the apparatus 10 generally consists of a container 12 which is formed by a bottom wall 13, side walls 14, and a top end 15. Hence, it will be appreciated that the container 12 forms a fluid reservoir chamber 16. The top end 15 of the container 12 is shown to be provided with two inlet ports 18 and 20 respectively, which take the form of a threaded neck 19 and 21 respectively. Threaded neck 18 is provided with a closure taking the form of a cap 23 which is provided with threads 24 in order to permit the screw-threading engagement of the cap 23 onto the threaded neck 19.

Similarly, inlet port 20 takes the form of a threaded neck 21 and is provided with a cap 26 which, again, is screw-threadedly mounted onto the threaded neck 21. The provision of two inlet ports 18 and 20 thereby permits the user to utilize the first inlet port 18 for drinking purposes, and the second inlet port 20 may be provided with a pump sprayer generally indicated by the numeral 28. It will therefore be appreciated that the user may engage the pump in order to expel a cooling fluid, particularly water, from the container 12 in order to perform a cooling function. Hence, it is contemplated that if the container 12 is filled with water, the user of the device may either drink from the device, or ultimately use it as a cooling device.

It will be further observed from FIG. 3, that the container 12 is provided with a configured depression 30 which, in this embodiment takes the shape of a rectangular configuration. It will be observed that a fan unit 32 is provided, having a back wall 34 which is configured to fit within the configured depression 30 of the container 12. The fan unit 32 takes the form of a fan housing 36 in which the operational mechanism for the fan will be located in the upper portion thereof, and the power supply is located in the lower portion thereof. The fan unit is completed by having a hub 38 upon which a plurality of fan blades 40 are carried. An on/off switch 42 is provided in order to activate the fan in the manner commonly known in the art. As shown in FIG. 1, the fan unit 32 is fitted within the configured depression 30 with the fan hub and fan blades extending outwardly therefrom in order to permit the fan to be operational when mounted onto the container 12.

The assembly is completed by means of an enveloping sheath 43 which is constructed with appropriate apertures in order to accommodate the two inlet ports 18 and 20 respectively, as well as the fan hub and fan blades 38 and 40 respectively, and the on/off switch 42. Hence, it will be observed that apertures 44 and 45 accommodate inlet ports 18 and 20 respectively, while aperture 47 accommodates the extended portion of the fan unit 32 including the fan hub and fan blades 38 and 40 respectively, and aperture 49 accommodates the on/off switch 42.

It is contemplated that the fan unit of the present invention is a typical battery operated portable fan formed by a housing, in which is contained the operational mechanism for the fan consisting of a motor 51, from which a motor shaft 52 extends outwardly to accommodate the mounting of the fan hub and blades 38 and 40 respectively. The construction of the fan unit 30 is not anticipated to be novel in and of itself other than in combination with the apparatus as depicted in FIGS. 1 and 3.

It will further be observed that the sheath 43 functions to envelope the container 12 and the fan unit 32 so that the fan unit is held in place in order to render the apparatus a complete combination of container and fan apparatus 10. The sheath may be formed of any suitable material such as cloth, vinyl, or other similar material. The particular material utilized is not considered to be inventive with respect to the subject matter of the present invention.

FIG. 5 represents a further refinement of the embodiment as depicted in FIGS. 1 through 4 of the invention. For ease of reference, similar numerals are applied to FIG. 5 with reference to the description therein. It will be observed that the features are basically identical other than the container 12 of FIG. 5 further includes a dividing wall 54 which divides the fluid reservoir chamber 16 into two chambers consisting of a drinking chamber 56 and a cooling chamber 58. The embodiment of FIG. 5 contemplates that the user may therefore employ the inlet port 18 as a drinking port in order to drink fluid which is contained within the drinking chamber 56, while the cooling chamber 58 may contain another fluid such as water, which would be expelled by the pump sprayer 28 in order to achieve a cooling effect. The container 12 is otherwise configured similarly to the embodiment as shown in FIGS. 1 and 3 in that it is provided with a configured depression 30 to accommodate the fan unit 32 therein. A sheath 43 is provided, once again, to accommodate the entire device being held together with the fan unit 32 held in mounting engagement within the configured depression 30 of the container 12. In all other respects, the unit 32 is constructed identically as previously described and is designed to be a portable battery operated fan unit including a battery power source as depicted in FIG. 3. As shown therein, a pair of typical batteries 39 are provided in order to power the fan unit.

As an alternative, one could provide a pair of side-by-side containers each having a flat wall such that the two containers may be maintained side-by-side and held together by the sheath 43 thereby to provide the same result, that being an overall container having two separate chambers. In such event, the two containers would be provided as separable containers.

Figure 9:
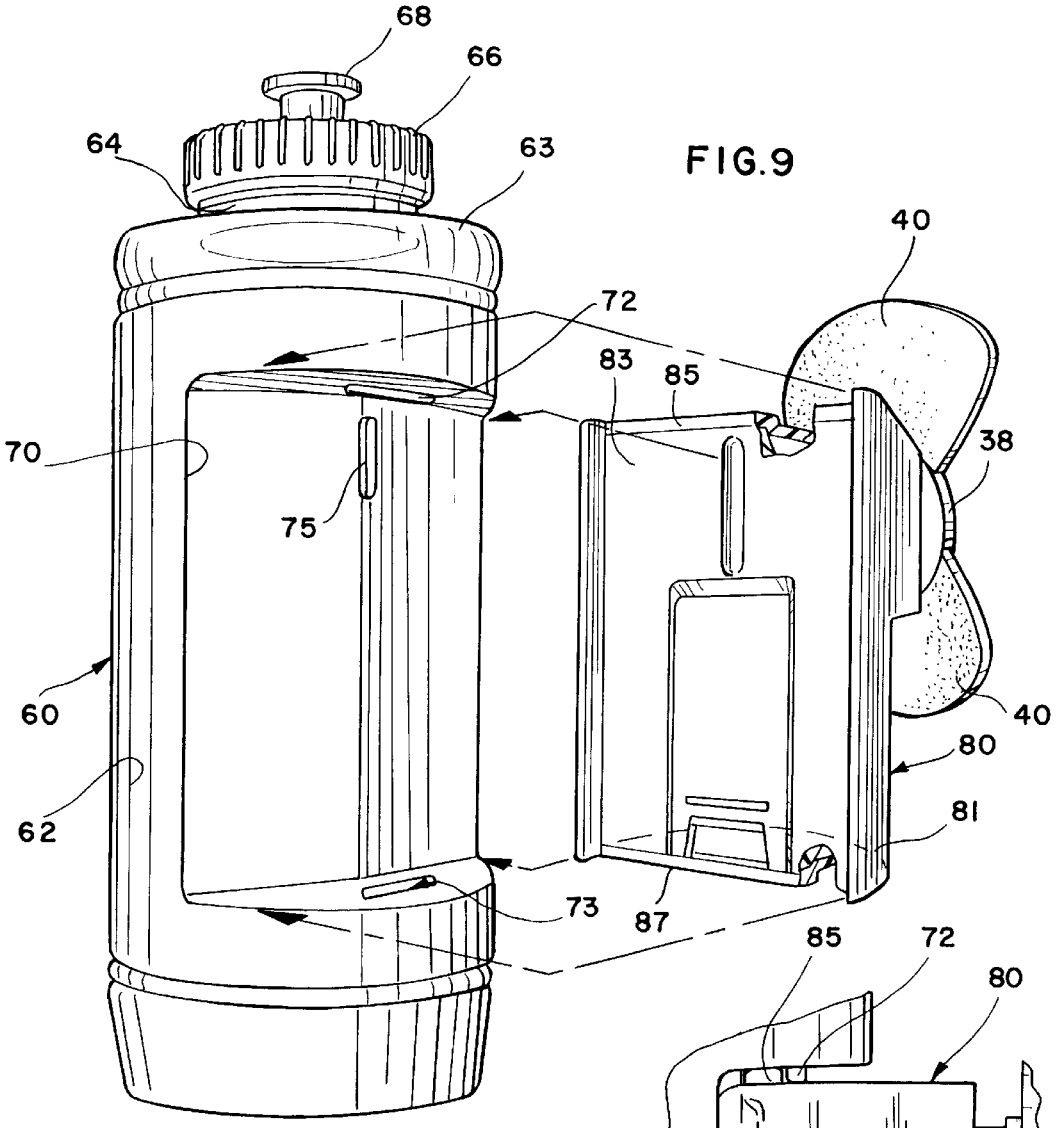
FIG. 9 is a plan elevational view showing an alternate form of a container including a configured depressed section to accommodate a portable battery operated fan to be mounted therein, and the holding means associated therewith.
Figure 10:
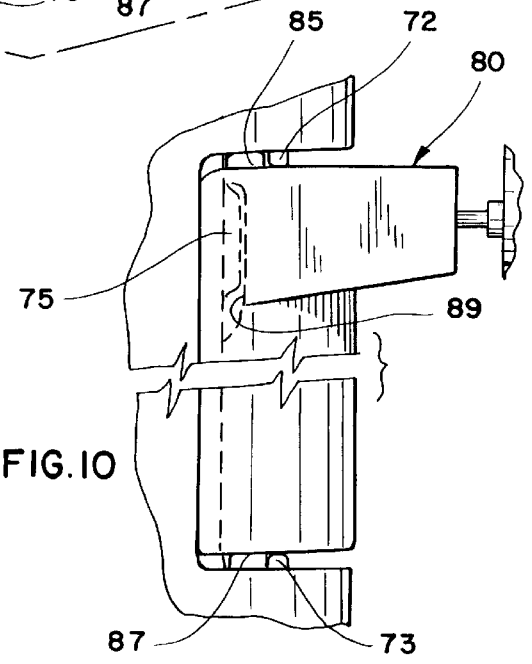
FIG. 10 is a side elevational view, partly broken away, showing the portable fan as mounted within the configured depressed area of the container and holding means associated therewith.

FIGS. 9 and 10 show an alternate embodiment of the apparatus of the present invention. As shown in FIG. 9, there is provided a container 60 which is in the form of a bottle, which includes a chamber 62 for containing a fluid therein. The container is provided with a top 63 which includes an inlet port 64 in order to accommodate the filling of the container 60. The inlet port 64 is enclosed by means of a cap 66 which may include a sipping valve 68 which is designed to pull upwardly in order to open and permit the user to sip, and push downwardly in order to close off the opening. A straw portion may be used in place of the sipping valve 68. The operation of such mechanisms is well-known in the art.

It will be observed that the container 60 is provided with a configured depression 70 formed along the side wall of the container 60. The configured depression 70 is shown to include an upper holding flange 72 and a lower holding flange 73. Further, a centering nib 75 is positioned approximately centrally of the configured depression 70 and along the upper end thereof.

The fan unit 80 is constructed as previously described, and includes a housing 81 which contains the operational mechanism for the fan and for the power supply therefor as previously described. The fan unit again is similar to that described with respect to FIGS. 1 through 5 and including the motor shaft which contains the hub 38 and fan blades 40 as previously described. In this embodiment, however, the back wall 83 includes an upper holding rail 85, and a lower holding rail 87. It will also be observed that the back wall 83 is provided with a centrally located recess 89 which is positioned to be in cooperative relationship with respect to the centering nib 75. It will therefore be observed that the fan unit 80 may be mounted into the configured recess 70 by inserting the fan unit such that the upper holding rail 85 is positioned behind the upper holding flange 72 of the container 70, and simultaneously the lower holding rail 87 being positioned behind the lower holding flange 73. The unit is then centered by sliding the unit until the centering nib 75 is positioned in recess 89.

It will be appreciated that other locking mechanisms may be employed in order to accomplish the mounting of the fan unit 80 into the configured recess 70. For example, nibs and flanges which would accommodate snap fitting are contemplated, as well as other mounting mechanisms presently available in the art. The particular mounting means employed is not considered to be critical with respect to the invention other than the provision of some mounting means in order to retain the fan in position within the configured recess.

It will also be observed that as an additional feature of the invention, the fan unit 80 may be provided with a pivotally battery cover/stand 91 such that when the fan unit 80 is removed from the unit, the back cover/stand 91 may be pivotally opened and function as a rest arm to retain the fan unit 80 in an upright position on a flat surface.

It is further contemplated that the fluid ports may take the form of a threaded neck and the closure therefor takes the form of a threaded cap. However, the fluid port may include a neck with a snap ring formed thereon and the cap includes a cooperating snap groove such that the cap snaps onto the neck. It is contemplated that any form of fluid port may be employed in combination with a cooperating closure so that such combination will be within the spirit and scope of the present invention.

Figure 6:
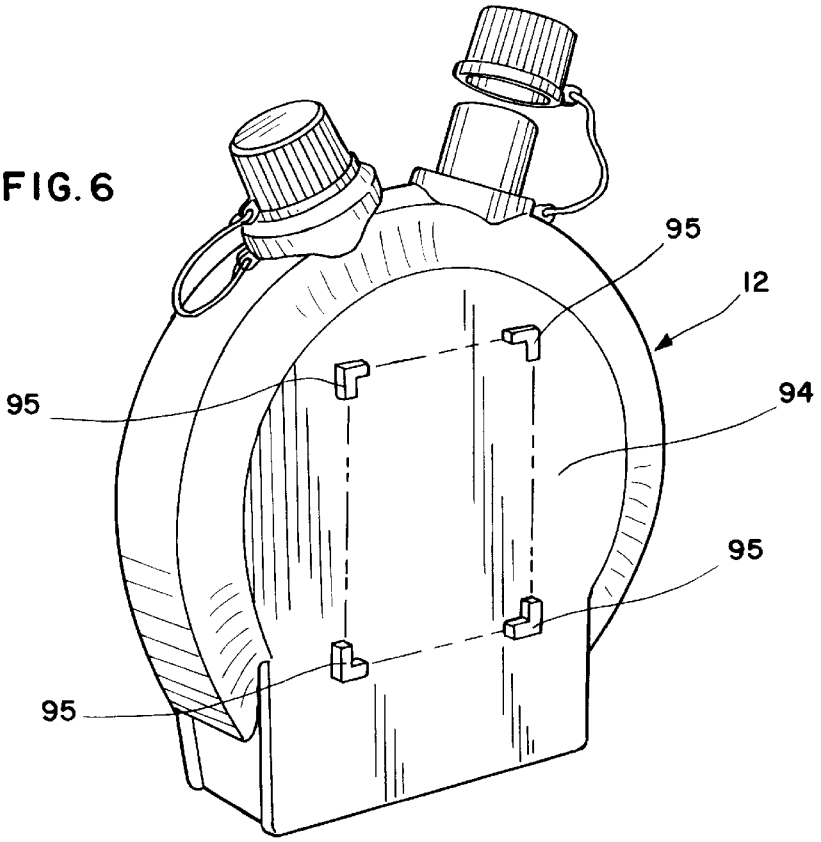
FIG. 6 is a perspective view of an alternate embodiment of the container wherein the mounting surface is formed by a flat side wall, and a series of four L-shaped bosses are provided to accomplish the snap fitting mounting of the fan unit therebetween.

FIG. 6 discloses a further embodiment of the present invention. In this embodiment, the container 12 is provided with a side wall 94 which is substantially flat. A series of four L-shaped bosses 95 are formed on the side wall 94. The fan unit is identical to the fan unit as disclosed with the respective FIGS. 9 and 10. The fan unit 80 is constructed to have a flat back wall 83 and the housing 81 is configured and sized to snap fit within the four L-shaped bosses 95. Hence, the fan unit 80 may be easily mounted onto the side wall 94 of the container 12 to provide the desired combination container/fan assembly.

Figure 7:
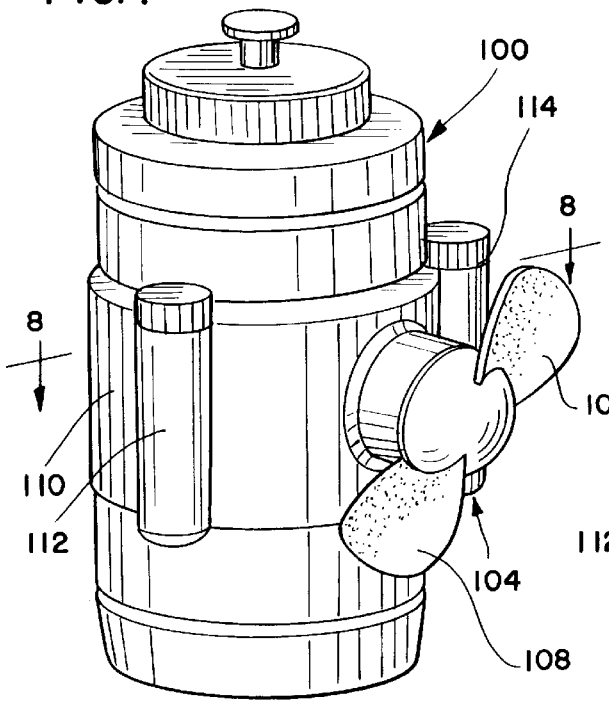
FIG. 7 is a side elevational view showing another alternate embodiment of a container/fan combination wherein the container has a circular configuration and the fan unit includes a pair of curvilinear arms having a mating configuration with the container to accommodate the snap fitting of the fan unit onto the mounting surface of the container.
Figure 8:
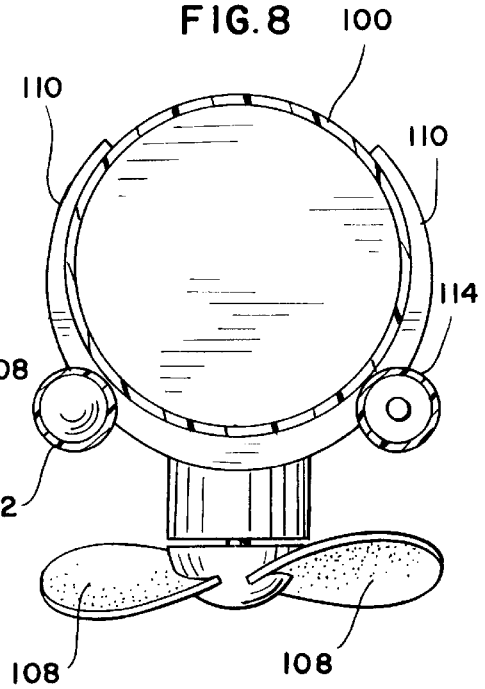
FIG. 8 is a cross-sectional view taken along the line 8—8 of FIG. 7 showing the manner in which the curvilinear arms of the fan unit snap fit onto the container side wall

A further alternative embodiment is shown in FIGS. 7 and 8. In this embodiment, the container 100 is shown to be circular in configuration as is typical of a plastic bottle container. The fan unit 104 is shown to include a central housing 106 which contains the fan motor (not shown) and having the fan shaft and fan blades 108 extending outwardly therefrom. The fan unit 104 further includes a pair of opposed curvilinear arms 110 extending laterally outwardly from the housing 106. The arms 110 are configured to extend slightly beyond a 180 degree arc and to be in cooperating mating configuration with the circular bottle. In this manner, the arms 110 accommodate the snap-fitting of the fan unit 104 onto the container 100.

It will also be observed that each of the arms 110 may be provided with a battery chamber 112 and 114 respectively to accommodate a battery 115 therein. Appropriate wiring would extend through the arms 110 to the housing 106 thereby to provide power to the fan unit 104. Hence, in this embodiment, the arms 110 form the holding means for accommodating the mounting of the fan unit 104 onto the container 100.

It is contemplated that other mounting configurations may be employed as between the container and the fan unit so long as the container provides a mounting surface for the fan unit and the fan unit is provided with a matingly engaging mounting surface relative to the container. Holding means may assume various configurations so long as the holding means accommodates the mounting and retention of the fan unit on the container side wall in engageable/disengageable arrangement.

It will be appreciated from the above description that an innovative combination container and fan unit apparatus has been provided which permits the user to enjoy the drinking of a beverage while simultaneously using the unit as a personal cooling unit. It is contemplated that various modifications may be made with respect to the components of the apparatus without departing from the true spirit and scope of the invention. Hence, while there has been described what is considered to be the preferred embodiments of the invention, it is intended to cover in the appended claims all obvious modifications and variations as fall within the true spirit and scope of the invention.

PARTS LIST

| | | | | | | | |
|---|---|---|---|---|---|---|---|
| 1 | | 34 | back wall | 67 | | 100 | container |
| 2 | | 35 | | 68 | sipping valve | 101 | |
| 3 | | 36 | fan housing | 69 | | 102 | |
| 4 | | 37 | | 70 | configured depression | 103 | |
| 5 | | 38 | hub | 71 | | 104 | fan unit |
| 6 | | 39 | batteries | 72 | upper holding flange | 105 | |
| 7 | | 40 | fan blades | 73 | lower holding flange | 106 | central housing |
| 8 | | 41 | | 74 | | 107 | |
| 9 | | 42 | on/off switch | 75 | centering nib | 108 | fan blades |
| 10 | container/fan apparatus | 43 | sheath | 76 | | 109 | |
| 11 | | 44 | aperture | 77 | | 110 | curvilinear arms |
| 12 | container | 45 | aperture | 78 | | 111 | |
| 13 | bottom wall | 46 | | 79 | | 112 | battery chamber |
| 14 | side walls | 47 | aperture | 80 | fan unit | 113 | |
| 15 | top end | 48 | | 81 | housing | 114 | battery chamber |
| 16 | fluid reservoir chamber | 49 | aperture | 82 | | 115 | |
| 17 | | 50 | | 83 | back wall | 116 | |
| 18 | inlet port | 51 | motor | 84 | | 117 | |
| 19 | threaded neck | 52 | motor shaft | 85 | upper holding rail | 118 | |
| 20 | inlet port | 53 | | 86 | | 119 | |
| 21 | threaded neck | 54 | dividing wall | 87 | lower holding rail | 120 | |

-continued

| PARTS LIST | | | |
|---|---|---|---|
| 22 | 55 | 88 | 121 |
| 23 cap | 56 drinking chamber | 89 recess | 122 |
| 24 threads | 57 | 90 | 123 |
| 25 | 58 cooling chamber | 91 battery cover/stand | 124 |
| 26 cap | 59 | 92 | 125 |
| 27 | 60 container | 93 | 126 |
| 28 pump sprayer | 61 | 94 side wall | 127 |
| 29 | 62 chamber | 95 L-shaped boss | 128 |
| 30 configured depression | 63 top | 96 | 129 |
| 31 | 64 inlet port | 97 | 130 |
| 32 fan unit | 65 | 98 | 131 |
| 33 | 66 cap | 99 | 132 |

What is claimed is:

1. The apparatus including a container forming a fluid reservoir and a fan unit associated therewith, comprising in combination:

a container being fully enclosed by a bottom wall, side walls and a top wall forming an internal fluid chamber, said top wall including a first fluid port and a second fluid port and said internal fluid chamber adapted to be a fluid reservoir, said internal fluid chamber divided into a first chamber and a second chamber, said fluid reservoir separated into said first chamber containing drinking fluid and said second chamber containing cooling fluid, said first fluid port corresponding to said first chamber and said second fluid port corresponding to said second chamber, a closure member adapted to alternately open and close said first fluid port and said second fluid port, said second fluid port accommodating a fluid pump carried therein, said side wall of said container providing a mounting surface, a fan unit including a housing including a back side and a front side and fan means extending outwardly from said front side of said housing, and holding means for holding said fan unit in place on said mounting surface of said container.

2. An apparatus including a container forming a fluid reservoir and a fan unit associated therewith, comprising in combination:

a container being fully enclosed by a bottom wall, side walls and a top wall forming an internal fluid chamber, said top wall including at least one fluid port and said container adapted to be a fluid reservoir, a closure adapted to alternately open and close said fluid port, a configured depression formed in a portion of the side wall of said container, a fan unit having a housing including a back side and a front side and fan means extending outwardly from said front side of said housing, said back side of said housing being configured and sized to fit within said depression formed in said side wall of said container, and a sheath for enveloping said container and said fan unit, said sheath provided with at least an aperture for said fluid port of said container and an aperture for said fan means thereby to permit access to said fluid port and the operational movement of said fan unit whereby said sheath operates to maintain said fan unit in attached relation to said container.

3. The apparatus as set forth in claim 2 above, wherein said fluid port is formed by a threaded neck and said closure includes mating threads to permit said closure to be alternately screwed on and off from said fluid port.

4. The apparatus as set forth in claim 2 above, wherein said fan unit includes a housing to accommodate the working mechanism for the fan means and the power source for said fan means.

5. The apparatus as set forth in claim 2 above, wherein said fan unit is provided with an on/off switch formed in the front side of said fan unit for operating said fan means and said sheath is provided with a further aperture for providing access to said on/off switch.

6. The apparatus as set forth in claim 2 above, wherein said container may include multiple fluid ports, at least one of said ports provided with a closure for alternately opening and closing said fluid port, and at least another fluid port to accommodate a fluid pump carried therein.

7. The apparatus as set forth in claim 2 above, wherein said depression in said side wall of said container is provided with a pair of opposed holding flanges formed therein and the back side of said fan unit housing is provided with a pair of opposed holding rails adapted and arranged to be in cooperative relation to said holding flanges in said container to accommodate the disengageable mounting of said fan unit on to said container.

8. The apparatus as set forth in claim 7 above, wherein said mounting flanges on said container and said mounting rails on said fan unit housing are designed to snap fit together thereby to accommodate the mounting of said fan unit onto said container.

9. The apparatus as set forth in claim 7 above, wherein said depression is further provided with a centering nib extending outwardly a short distance, and said back wall of said fan unit housing includes a centering recess formed therein and in cooperating relation with said nib, whereby said nib fits within said recess when said fan unit is mounted onto said container to center said fan unit within said depression of said container to center said fan unit within the confines of said configured depression.

10. The apparatus as set forth in claim 6 above, wherein said container is provided with an internal dividing wall thereby to divide said reservoir into two chambers, one chamber containing drinking fluid for drinking and the other chamber containing cooling fluid, and each chamber includes a fluid port to provide access to one chamber separately from the other chamber.

11. The apparatus as set forth in claim 6 above, wherein each fluid port is formed by a threaded neck and each closure includes mating threads to permit said closure to be alternately screwed on and off of said fluid port.

12. The apparatus as set forth in claim 2 above, wherein said fan means comprises a fan motor contained within said fan unit housing, and a fan shaft extending outwardly from said front side of said fan unit housing, and having a fan hub with associated fan blades mounted on said fan hub.

13. The apparatus as set forth in claim 12 above, wherein said fan blades are formed from a soft foam material.

14. The apparatus as set forth in claim 1 above, wherein said holding means comprises a plurality of mounting bosses formed on the side wall of said container, said bosses being spaced and arranged to accommodate the mounting of said back side of said fan unit housing therebetween.

15. The apparatus as set forth in claim 14 above, wherein said side wall of said container is provided with a series of at least four bosses formed thereon, each of said bosses being L-shaped in configuration, and said bosses being arranged to accommodate the snap fitting of the back side of said fan unit therebetween to hold said fan unit on said container.

16. The apparatus as set forth in claim 1 above, wherein said fan unit housing includes a pair of opposed curvilinear arms extending laterally outwardly therefrom, said curvilinear arms being sized to snap fit onto the mounting surface of said container thereby to mount and hold said fan unit onto of said container.

* * * * *